United States Patent [19]

Bolton

[11] 4,307,579

[45] Dec. 29, 1981

[54] DISCHARGE DOOR STIFFENER FOR AN AIR CONDITIONING UNIT

[75] Inventor: Theodore S. Bolton, Liverpool, N.Y.

[73] Assignee: Carrier Corporation, Syracuse, N.Y.

[21] Appl. No.: 1,565

[22] Filed: Jan. 5, 1979

[51] Int. Cl.[3] ..... F25D 23/12

[52] U.S. Cl. ..... 62/262; 98/94 AC; 16/119; 49/261

[58] Field of Search ..... 62/262; 98/94 AC; 49/381, 383, 384, 385, 400, 208, 261; 16/119

[56] References Cited

U.S. PATENT DOCUMENTS

| | | | |
|---|---|---|---|
| 1,925,817 | 9/1933 | Plym | 49/383 |
| 1,931,910 | 10/1933 | Wells | 16/191 |
| 2,556,407 | 6/1951 | Wilke | 49/383 |
| 3,431,748 | 3/1969 | Bolton | 62/262 |
| 3,504,617 | 4/1970 | Merklin | 98/94 X |
| 3,537,212 | 11/1970 | Gilles | 49/381 |
| 3,703,087 | 11/1972 | Macleod | 62/262 |
| 3,789,619 | 2/1974 | Kincaid et al. | 62/262 |

*Primary Examiner*—Albert J. Makay
*Assistant Examiner*—Henry Bennett
*Attorney, Agent, or Firm*—J. Raymond Curtin; Robert P. Hayter

[57] ABSTRACT

Apparatus including a discharge door assembly for use with a room air conditioner. A discharge door is pivotally mounted at the ends and has a tab extending therefrom into a slot formed in a frame portion of the front panel of the air conditioning unit. The tab and slot coact to limit inward deflection of the discharge door. The frame portion of the front panel is angled to contact the discharge door to limit angular rotation thereof.

6 Claims, 4 Drawing Figures

DISCHARGE DOOR STIFFENER FOR AN AIR CONDITIONING UNIT

BACKGROUND OF THE INVENTION

1. Field of the Invention

This invention relates to air conditioning units and more particularly to a discharge door stiffener for use with a room air conditioning unit. Specifically, the invention involves the use of a tab coacting with a slot located in the middle of a pivotally mounted door to limit inward deflection of said door.

2. Description of the Prior Art

Residential air conditioning units especially those which extend through the wall of a residence or are mounted in a window of a residence include a discharge port for discharging conditioned air from the unit into the space to be conditioned. A door is mounted to cover the port such that flow through the port may be controlled. When such a unit is not in use the discharge door is normally closed for esthetic purposes, to prevent persons from accidentally striking the door and to prevent the insertion of articles into the unit through the discharge port. When the unit is being operated it is important that the discharge door open to allow for conditioned air to be discharged from the unit. Should the door fail to open it is possible for ice to build up on the evaporator which may result in overheating of the compressor. Moreover failure of the door to open and close properly can cause the thermostatic controls of the unit to shut down the unit before the space has been conditioned.

It has become well known in the art to utilize a horizontally extending door pivotally mounted on each end for covering a discharge port of a room air conditioning unit. This door is mounted such that when the air conditioning unit is turned on the flow of air to the discharge area serves to open the door allowing conditioned air to be discharged into the room. Typical of patents disclosing this type of door are U.S. Pat. Nos. 3,789,619; 3,431,748 and 3,703,087. In each of these patents there is disclosed a door extending horizontally across the front of a room air conditioning unit which is pivotally mounted to swing open at the top under the appropriate conditions.

It has been found that with a long door pivotally mounted at the ends that there is a potential for deflection of the door between hinge locations. The herein invention is concerned with modifications of a door assembly such that inward deflection of the door between the hinges is limited.

SUMMARY OF THE INVENTION

An object of the present invention is to provide a discharge door for room air conditioning unit.

A further object of the invention is to provide means which limit the inward deflection of a discharge door of a room air conditioning unit mounted pivotally at each end thereof.

Another object of the invention is to provide an esthetically pleasing discharge door for room air conditioning units with inward deflection limiting means.

A further object of the present invention is to provide a safe, economical and reliable door mounting and assembly means which is economical to manufacture and easy to assemble in a room air conditioning unit.

Other objects will be apparent from the description to follow and from the appended claims.

The foregoing objects are achieved according to a preferred embodiment of the invention by the provision of an air conditioning unit having a discharge opening covered by a discharge door. The discharge door is pivotally mounted on either end thereof such that the upper part of the door swings outwardly allowing conditioned air to be discharged from the unit into the room to be conditioned. The bottom of the door coacts with an inclined surface formed from a frame portion of the front panel of the room unit such that rotation of the door is not impeded thereby. A tab extends from the bottom of the door into a slot defined in the frame portion of the front panel, said tab engaging a slot stop surface at the back of the slot to prevent inward deflection of the door without impeding rotational movement thereof. The bottom surface of the door and the inclined surface of the frame engage after a certain amount of angular rotation to prevent further rotation of the door.

DESCRIPTION OF THE PREFERRED EMBODIMENT

The present invention provides a simple efficient apparatus for preventing inward deflection of a discharge door which is pivotally mounted at the ends in a room air conditioning unit. The preferred embodiment contemplates a single tab mounted in the center of the lower edge of the door extending into a slot such that the single tab prevents inward deflection of that portion of the door where it is mounted. It is within the scope of the present invention to provide a multiplicity of slots and tabs spaced along the door to serve this purpose. It is further within the scope of the present invention to provide coacting door and frame surfaces.

Figure 1:
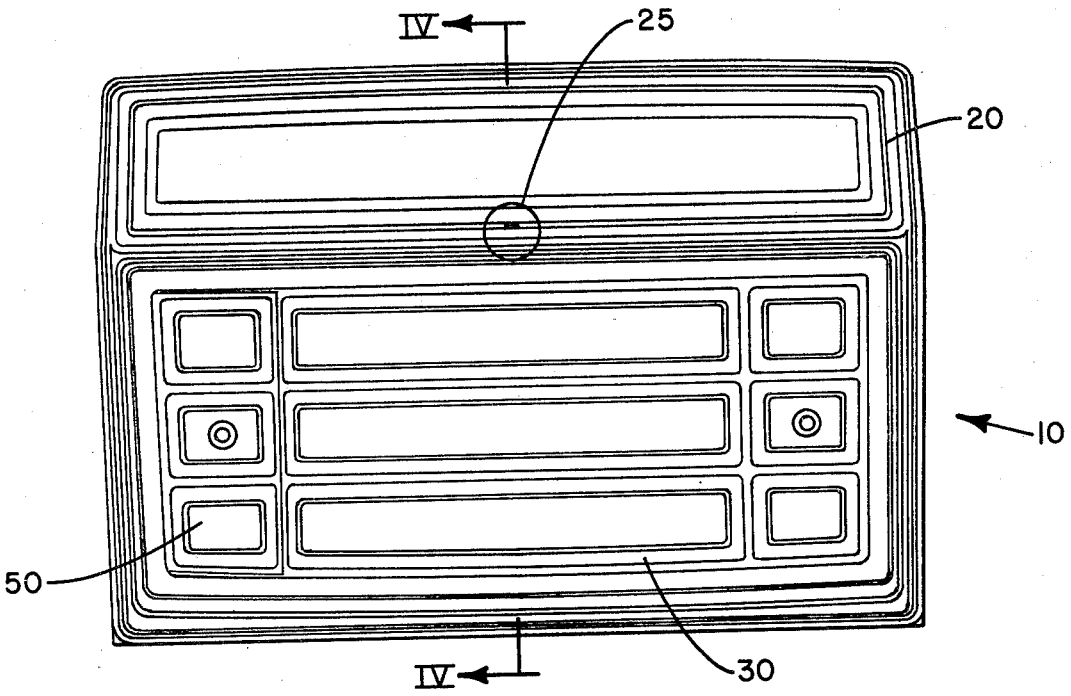
FIG. 1 is a front view of front cover of a room air conditioning unit showing the front panel and discharge door.
Figure 4:
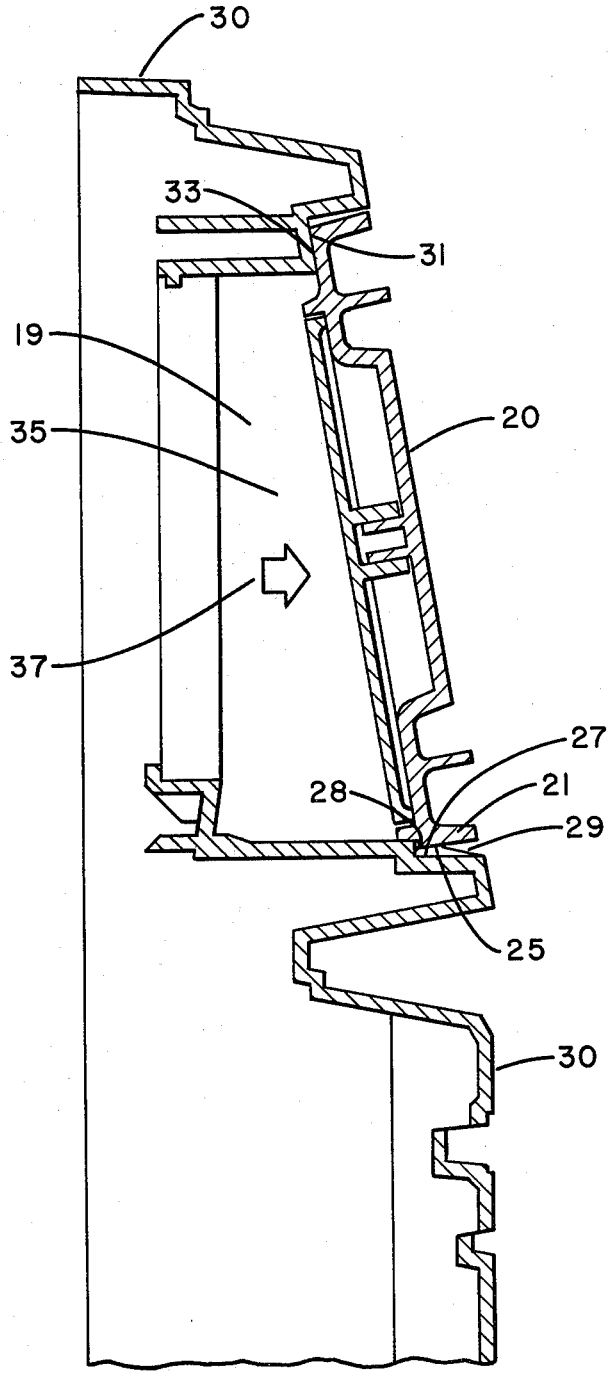
FIG. 4 is a larger cross-sectional view taken along line IV—IV of FIG. 1 showing the interaction of the door and front panel.

Referring now to FIG. 1 there can be seen front cover 10 of a room air conditioning unit. Front cover 10 has front panel 30 which covers the portion of a room air conditioning unit extending into the enclosure to be conditioned. Discharge door 20 is mounted to coact with front panel 30 such that a discharge opening from which air that has been conditioned is circulated from the room air conditioner to the room is covered by the door. Control access door 50 is also shown in FIG. 1 and it is that door which may be pivotally rotated to expose the various controls for operating the air conditioning unit. In FIG. 4 there can be seen a tab 25 extending from the bottom of discharge door 20.

Figure 2:
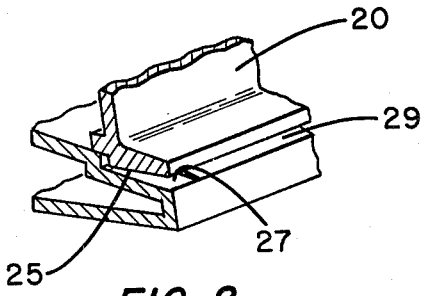
FIG. 2 is an enlarged perspective view of the tab and slot of the herein invention from FIG. 1.

FIG. 2 is an enlarged portion of a segment of FIG. 1 showing tab 25 extending downwardly from door 20 and showing slot 27 formed from a portion of front panel 30.

Figure 3:
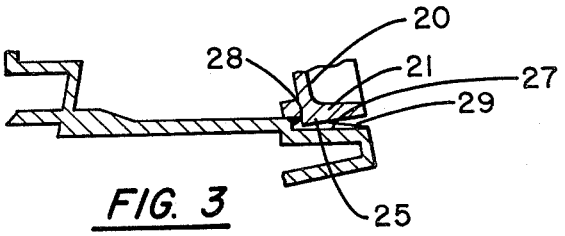
FIG. 3 is a partial cross-sectional view taken along line IV—IV in FIG. 1 showing the slot and tab.

FIGS. 3 and 4 are cross-sectional views of the front panel 30 and door 20 showing their interaction. As can be seen therein front panel 30 encases the end of the unit such that an opening is created which is covered by door 20. Louver location 35 is pointed out to indicate where louvers may be mounted to direct air flow out of the discharge opening. Arrow 37 is shown to indicate the direction of air discharge through discharge opening 19.

Front panel 30 has front panel contact surface 33 which meets with door contact surface 31 to provide a stop at the top of door 20. Front panel 30 additionally has frame bottom 23 and slot stop 28 together with inclined surface 29 located in the area adjacent to the bottom of door 20. Inclined surface 29 extends across the unit except for the slot portion and is arranged such that door 20 may be rotated on hinges (hinges suitable for use herewith are shown in U.S. Pat. No. 3,431,748). located at both ends of the door such that the top of the door pivots outwardly allowing air to be discharged from the unit and the bottom of the door pivots in close proximity to inclined surface 29. Slot 27 is formed within the front panel such that frame bottom 23 and slot stop 28 comprise the bottom and back surfaces thereof. The ends of slot 27 are formed from the edges of inclined surface 29 remaining upon formation of the slot. Tab 25 extends from door bottom 21 of door 20 into slot 27. Tab 25 is a surface which upon a linear movement of the door in a right-to-left direction as shown in FIG. 4 contacts slot stop 28. Contact of this tab with the slot stop acts to limit the inward deflection of the bottom door at this location.

The bottom surface of the door is approximately parallel to the bottom of slot 27 shown as frame bottom 23 such that when the door is rotated eventually the door bottom 21 will contact inclined surface 29 limiting the outward rotation of door 20. Additionally, the lower portion of tab 25 is angled from door bottom 21 such that it may rotate in slot 27 without engaging frame bottom 23 to impede rotation of the door.

There has been described a simple apparatus to prevent the inward deflection of a pivotally mounted door secured at either end thereof. The creation of a slot and tab and their interaction result in slot stop 28 and tab 25 engaging each other to allow only a small predetermined amount of inward deflection at the bottom of the door. This interaction aids overall door stiffness and promotes the overall structural life of the discharge door.

The invention has been described in detail with particular reference to the preferred embodiment thereof but it will be understood that variations and modifications can be effected within the spirit and scope of the invention.

I claim:

1. A door assembly for an air conditioning unit having a discharge door opening through which conditioned air to be delivered to the enclosure is discharged which comprises:

a front panel having frame portions which define an opening through which air may be discharged including a frame bottom having an inclined surface and additional frame bottom surfaces defining a slot in the inclined surfaces;

a door for covering the opening defined by the frame portions of the front panel;

hinge means for pivotally securing the bottom of the door such that the door pivots outwardly at the top to open allowing passage of discharge air from the unit and the bottom of the door rotates in close proximity to the inclined surface; and a tab extending from and across a portion of the bottom of the door into the slot defined by the front panel frame bottom, said tab being received within said slot such as to permit pivotal movement of the door about the hinge means but to engage an inner frame bottom surface defining a back portion of the slot to prevent buckle deflection of the door.

2. The apparatus as set forth in claim 1 wherein the hinge means secure the door on both ends and the slot is located therebetween.

3. The apparatus as set forth in claim 2 wherein the slot is centered between the ends of the door and has a slot stop surface which is contacted by the tab extending from the door to limit inward deflection from the door.

4. The apparatus as set forth in claim 1 wherein the door has a bottom surface located in cooperation with the inclined surface of the front panel such that the two surfaces engage after a predetermined amount of angular rotation of the door to prevent further rotation.

5. The apparatus as set forth in claim 4 wherein the tab has a lower surface angled from the bottom surface of the door and wherein the slot has a frame surface generally parallel with the bottom surface of the door when the door is in the closed position such that angled lower surface of the tab coacts with the frame surface not to impede angular rotation of the door.

6. A room air conditioning unit for conditioning air to be discharged into an enclosure having a discharge opening through which conditioned air is discharged and a door assembly which comprises:

a front panel having frame portions which define an opening through which air may be discharged and a frame bottom having an inclined surface with additional surfaces defining a slot;

a door for covering the opening defined by the frame portions of the front panel;

hinges for pivotally securing the door on either end thereof such that the door pivots outwardly at the top to open allowing the discharge of air from the unit and the bottom of the door rotates in close proximity to the inclined surface;

a tab extending from and across a portion of the bottom of the door into the slot defined by the front panel frame portions, said tab being received within said slot such as to permit pivotal movement of the door about the hinge means but to engage an inner frame bottom surface defining a back portion of the slot to prevent buckle deflection of the door; and said bottom surface being located to cooperate with the inclined surface of the front panel such that the two surfaces engage after a predetermined amount of angular rotation of the door to prevent further rotation thereof.

* * * * *